US006017223A

United States Patent [19]

Lai

[11] Patent Number: 6,017,223

[45] Date of Patent: Jan. 25, 2000

[54] ELECTRICAL CONNECTOR WITH AN INSPECTING MEAN FOR INSPECTING THE ELECTRICAL CONNECTION

[75] Inventor: Chin-Yi Lai, Sunnyvale, Calif.

[73] Assignee: Hon Hai Precision Ind. Co., Ltd., Taipei Hsien, Taiwan

[21] Appl. No.: 08/882,910

[22] Filed: Jun. 26, 1997

[30] Foreign Application Priority Data

Jun. 29, 1996 [TW] Taiwan ..... 85209866

[51] Int. Cl.[7] ..... H01R 3/00

[52] U.S. Cl. ..... 439/79

[58] Field of Search ..... 439/188, 79, 910

[56] References Cited

U.S. PATENT DOCUMENTS 5,085,601 2/1992 Buchter et al. ..... 439/79

5,320,541 6/1994 Korunsky et al. ..... 439/79

5,533,901 7/1996 Hunt et al. ..... 439/79

*Primary Examiner*—Michael L. Gellner

*Assistant Examiner*—Briggitte R. Hammond

[57] ABSTRACT

An electrical connector for electrically connecting an exterior mating connector to a PC board, comprises an insulation housing including a first passageway, a second passageway and a plurality of third passageways. A plurality of conductive contacts are received within the third passageways. An inspecting mean includes a first terminal received within said first passageway for electrical connection with an inspecting circuit on PC board, and includes a second terminal having a first beam received within said first passageway and a second beam and a third beam received within the second passageway for electrical connection with a grounding circuit on PC board.

3 Claims, 3 Drawing Sheets

ELECTRICAL CONNECTOR WITH AN INSPECTING MEAN FOR INSPECTING THE ELECTRICAL CONNECTION

BACKGROUND OF THE INVENTION

1. Field of The Invention

The invention relates to an electrical connector for use with an exterior mating connector to transmit electrical signals therebetween, and particularly to one connector having an inspecting mean which is able to inspect whether the electrical connection with an exterior mating connector is current for self-inspection.

2. The Prior Art

As known, the local network is widely used in the computerized system at present, because the local network is able to transmit common data among a host server and a plurality of different work stations for sharing information, by means of electrical and mechanical connection among some male and female connectors in the computers and/or their peripheral apparatus.

However, as mentioned above, the network can link many electrical apparatus, e.g. the server, the computers or the printers, by the connectors installed in these apparatus. When too many apparatus are linked together and a poor contact manner is found thereof, it is hard and wastes time to respectively inspect by eyes of the user, whether the connections between pairs of mutually mated connectors of different apparatus are current. Consequently, it is worthy to consider how to improve the electrical connector to make a seif-inspection to its electrically poor connection, and at the same time, to send the result of the inspection to the user via the apparatus, when the network system is in operation.

Accordingly, for resolving the above disadvantages, an object of the invention is to provide an improved electrical connector with an inspecting mean which is designed to have a multi-beam structure, for establishing an electrical connection among an inserted mating connector of an apparatus and different circuits on the PC board of another apparatus, to obtain multiple functions, such as grounding and self-inspection to their electrically poor connection via said circuits. Therefore, it is convenient and saves time for user to directly obtain inspecting information from the display device of the related apparatus as the monitor.

SUMMARY OF THE INVENTION

According to an aspect of the invention, an electrical connector for electrically connecting an exterior mating connector to some predetermined circuits on the PC board, includes an insulation housing having first, second and third passageway. A plurality of conductive contacts are respectively received in said third passageways. The inspecting mean at least includes a first terminal received within said first passageway and forming therein a bended curve engaging portion, and includes a second terminal having a first beam forming therein a stamped curve engaging portion and received within said first passageway. The second terminal further has a second beam and a third beam which are opposite to each other and are received together within the second passageway, for electrical connection with grounding and inspection circuits on the PC board.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
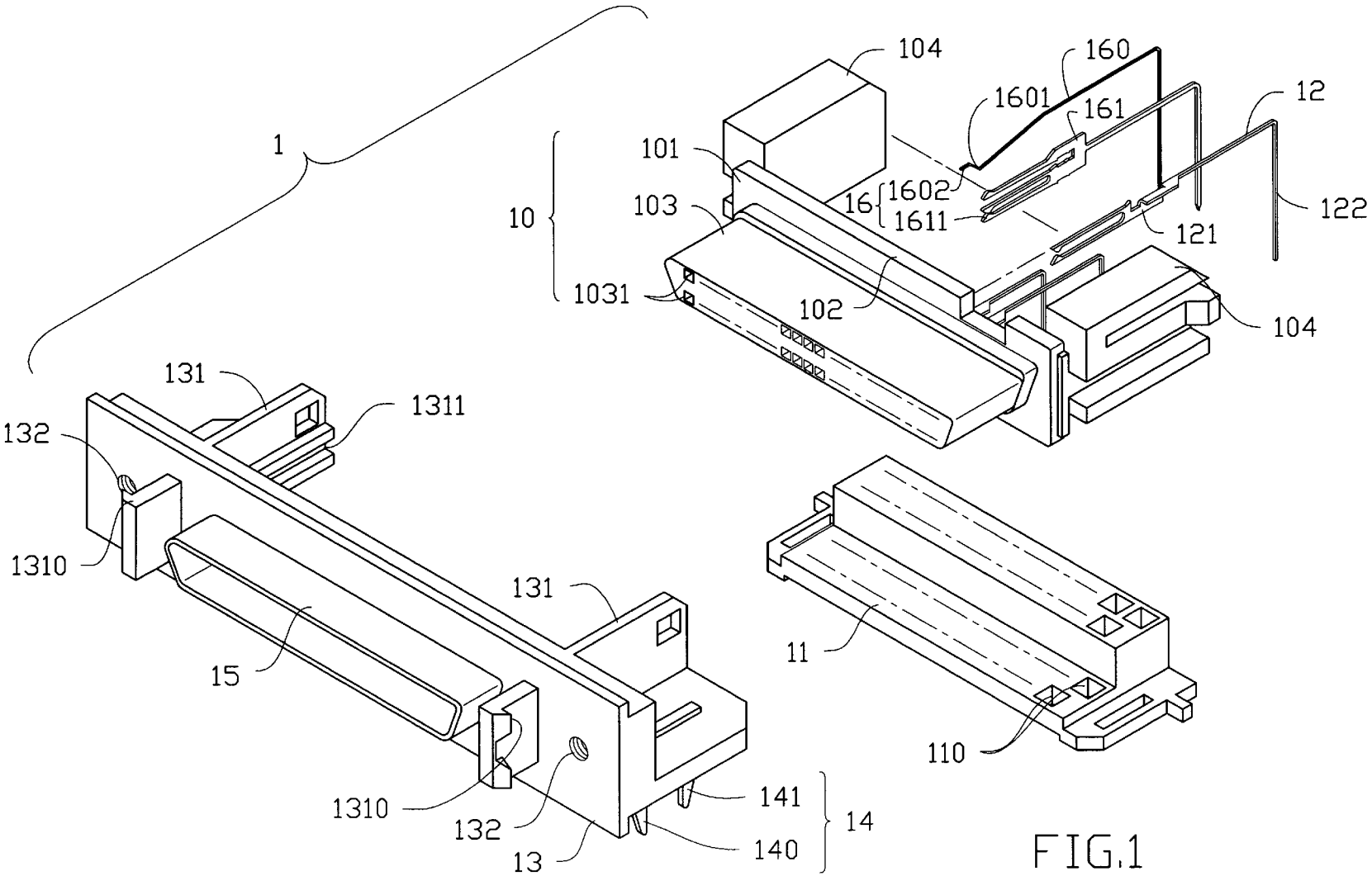
FIG. 1 is an exploded perspective view of the electrical connector of first embodiment of the present invention.
Figure 2:
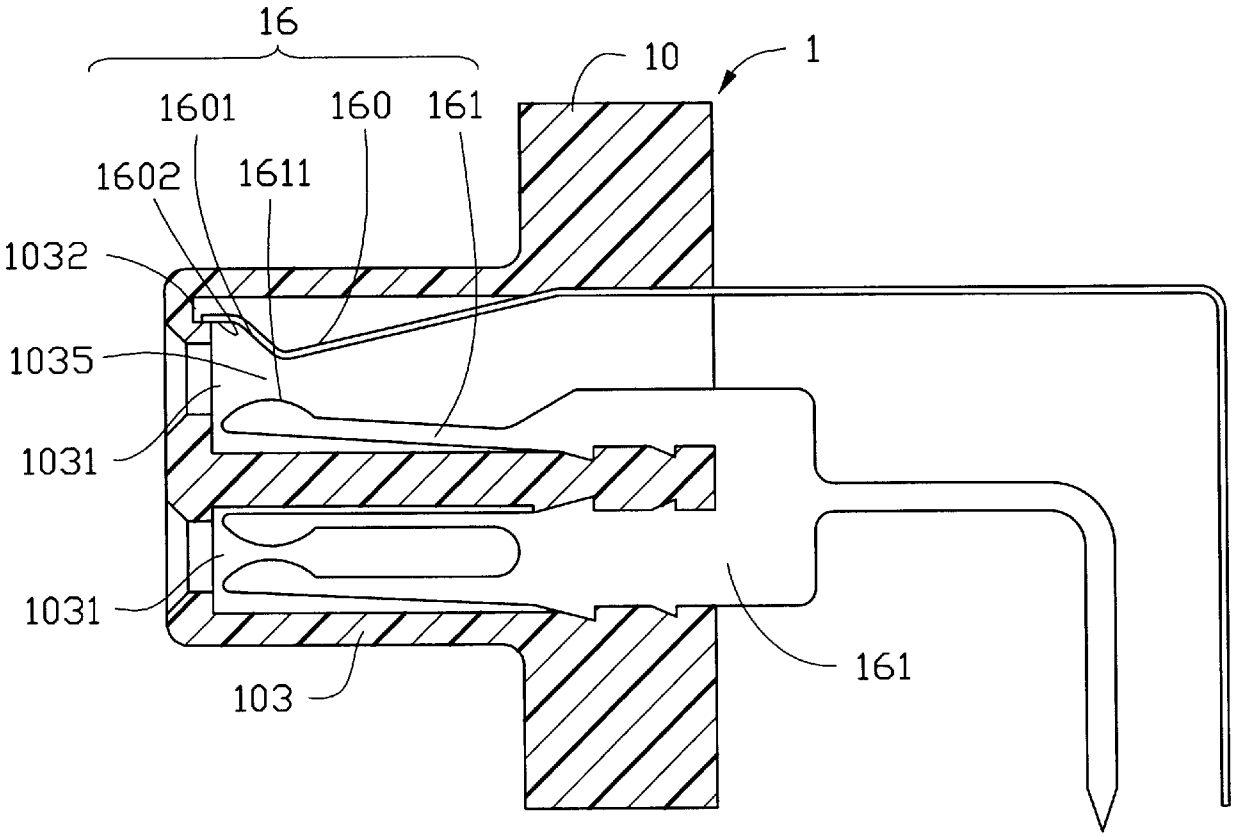
FIG. 2 is a partially cross-sectional view in accordance with the electrical connector as shown in FIG. 1.

It will be noted here that for a better understanding, most of like components are designated by like reference numerals throughout the various figures in the embodiments. The first embodiment of the present invention will now be shown with reference to FIGS. 1–2. An electrical connector 1 as shown in FIGS. 1 and 2, mainly includes an elongated insulation housing 10, an insulation plate 11, a plurality of conductive contacts 12, a bracket 13 made of conductive metal, a pair of retentive means 14, a shell 15 made of conductive metal and an inspecting mean 16.

The insulation housing 1 has a mating surface 101 against the mating direction of an exterior mating connector (not shown), and a mounting surface 102 opposed to said mating surface 101. A mating extension 103 extends a predetermined length from said mating surface 101 outward, which is formed integrally with a plurality of passageways 1031 in two rows. Wherein said passageways 1031 at least include a first passageway 1031 located in the top row and having therein a recess 1032 adjacent to an opening of the passageway 1031, and a second passageway 1031 located in the bottom row, and a plurality of third passageways 1031 for receiving the contacts 12 therein. An auxiliary positioning block 104 having some outward extending protrusions, is formed integrally with the either of two opposed lateral sides of the insulation housing 10, for retaining the insulation housing 10 within said bracket 13.

The insulation plate 11 having therein a plurality of through holes 110 with reference to said passageways 1031, is deposited in the bottom of said insulation housing 10, for receiving the tail 122 of contacts 12 and positioning each tail 122 to aim at the corresponding hole on the PC board (not shown).

The metal bracket 13 is generally positioned in front of the housing 10, of which one surface is formed with a pair of latches 1310 extending outwardly and longitudinally, for latching the connector 1 and an exterior mating connector (not shown) together, and an outwardly extending shell 15 located between said pair of latches 1310 and having therein an opening for receiving the mating extension 103 of the insulation housing 10. Therefore, the shell 15 can surround the periphery of the mating extension 103 to shield and protect the mating area between said connectors. On the opposed surface of the metal bracket 13, a pair of host positioning blocks 131 are formed therewith for cooperation with said the auxiliary positioning blocks 104 of insulation housing 10. The host positioning block 131 has a extending slot 1311 and a square hole for respectively receiving the portions of the auxiliary positioning blocks 104, for the retainable combination between the insulation housing 10 and bracket 15.

The retentive mean 14 is defined by a pair of claws 140, 141 having resilience therein and is adapted to be inserted into the corresponding slot on the PC board, through one lateral slot of insulation plate 11, for retainably mounting whole electrical connector 1 on the PC board.

The conductive contacts 12 being received within said third passageways 1031, each includes a fork-like engaging portion 121 for electrical engagement with one inserted corresponding contact (not shown) of the exterior mating connector, and a tail 122 downward and vertically extending from said mounting surface 102 to be inserted into the corresponding hole and to be soldered with one corrsponding circuit on the PC board.

The inspecting mean 16, as shown in FIGS. 1 & 2, at least includes a first terminal 160 and a second terminal 161, wherein the first terminal 160 and a first beam of second terminal 161 are opposite to each other and are received together within the first passageway 1031 of the insulation housing 10. The first terminal 160 further has a free end 1602 extending into said recess 1032 of first passageway 1031 for restricting the free end 1602 from moving in a predetermined distance, and has therein a curve engaging portion 1601 which is formed by a bending process in a downward convex.

In the first passageway 1031, the first beam of second terminal 161, is basically designed to be a upwardly slanted cantilever structure with regard to a bottom-wall of first passageway 1031 and is formed integrally with a curve engaging portion 1611 adjacent to a free end thereof by a stamping process. Therefore a receiving space 1035 is formed between the first terminal 160 and first beam of second terminal 161, and has therein a narrower front portion and a wider rear portion, and at the same time, the stamping type engaging portion 1611 can provide a higher structural strength (i.e. stiffness), and the bending type engaging portion 1601 can provide more elasticity to obtain a properly clamping force therebetween to elastically clamp and electrically engage an inserted corresponding terminal (not shown) of the exterior mating connector.

The first terminal 160 further has a tail downward and vertically extending from the mounting surface 102 for being electrically connected with an corresponding inspecting circuit (not shown) on the PC board. Thus an inspecting path is established from said inspecting terminal of mating connector to the inspecting circuit on the PC board, via the first terminal 160, so that when the electrical apparatus installed with said connector 1, is operated by the user, the inspecting information is able to be directly obtained from a predetermined display device as the monitor of the electrical apparatus (not shown), via the inspecting circuit.

Additionally, the second terminal further includes a second beam and a third beam formed integrally with said first beam in first passageway 1031. The second beam is opposite to first and third beams with the engaging portions therein, and the second and third beams are received together within said second passageway for elastically clamping and electrically engaging a grounding terminal (not shown) of the exterior mating connector, wherein some barb mean are arranged in a lateral side of each beam of second terminal. The second terminal further has a tail extending downward and vertically to be connected with a grounding circuit (not shown) on the PC board, whereby a grounding path is established from said grounding terminal of mating connector to the grounding circuit on the PC board, via the second and third beams of the second terminal 161.

Attention to the arrangement of the engaging portions 1601, 1611 of first and second terminals 160, 161 in first passageways, as shown in FIG. 2, both are located in the same vertical plane, so that when said inspecting terminal of mating connector is inserted into the corresponding first passageway 1031, the inspecting terminal can electrically engage the first and second terminals 160, 161 in the up-and-down direction, simultaneously, and both of the grounding function and the self-inspection function, are also obtained.

Understandably, if the engaging portion 1611 of first beam of second terminal 161 is designed near the opening more than the engaging portion 1601 of first terminal 160 in a longitudinal direction, the inspecting terminal will first engage the first beam of second terminal 161 to ground via grounding circuit for discharging the noise in the signals when the inspecting terminal is inserted into the first passageway 1031, and afterward, further engage the first terminal 160 to be electrically connected with the inspecting circuit on PC board. In contrast, if the engaging portion 1601 of first terminal 160 nears the opening more than the engaging portion 1611 of first beam of second terminal 1611, the inserted inspecting terminal will first engage the first terminal 160 to accomplish the inspection.

Figure 3:
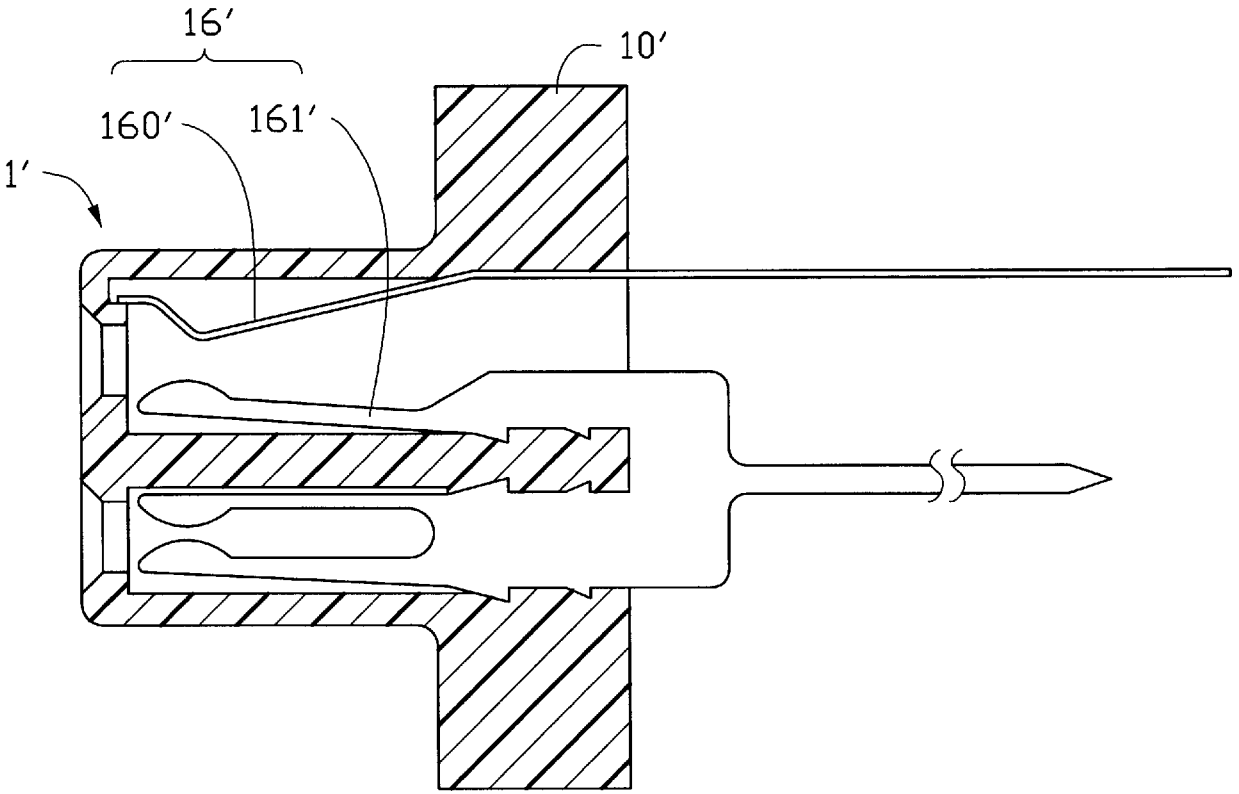
FIG. 3 is a partially cross-sectional view of second embodiment of the present invention, that indicates another type of first and second terminals.

Certainly, the second embodiment of the present invention as shown in FIG. 3, further provides that the straight tails of first and second terminals 160', 161' can be used with vertical mounting type electrical connector 1' of which mounting surface is parallel to the top surface of PC board.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector for electrically connecting an exterior mating connector to a PC board, comprising:

an elongated insulation housing, defined by at least a mating surface and a mounting surface which are located in opposite directions, and further forming integrally therein a plurality of passageways defined with at least a first passageway and a second passageway;

at least one terminal at least having a first beam forming a first engaging portion and received within the first passageway, a second beam forming a second engaging portion and received within the second passageway, a third beam forming a third engaging portion thereon, and having a tail for electrically connecting with a corresponding circuit formed on the PC board wherein the third engaging portion of the third beam is opposite to the second engaging portion of the second beam.

2. The electrical connector as described in claim 1, wherein the first engaging portion of the first beam is opposite to the second engaging portion of the second beam.

3. The electrical connector as described in claim 1, wherein said electrical connector further has a plurality of contacts.

* * * * *